US005082757A

United States Patent [19]

Keoshkerian et al.

[11] Patent Number: 5,082,757

[45] Date of Patent: Jan. 21, 1992

[54] ENCAPSULATED TONER COMPOSITIONS

[75] Inventors: Barkev Keoshkerian, Thornhill; Beng S. Ong, Mississauga, both of Canada

[73] Assignee: Xerox Corporation, Stamford, Conn.

[21] Appl. No.: 575,747

[22] Filed: Aug. 31, 1990

[51] Int. Cl.[5] ..... G03G 9/093

[52] U.S. Cl. ..... 430/106; 430/106.6; 430/109; 430/110; 430/126; 430/138; 428/402.24

[58] Field of Search ..... 430/106, 106.6, 109, 430/110, 126, 138

[56] References Cited

U.S. PATENT DOCUMENTS

| | | | |
|---|---|---|---|
| 3,898,171 | 8/1975 | Westdale | 430/110 |
| 4,442,194 | 4/1984 | Mikami | 430/137 |
| 4,465,755 | 8/1984 | Kiritani et al. | 430/111 |
| 4,520,091 | 5/1985 | Kakimi et al. | 430/110 |
| 4,592,957 | 6/1986 | Dahm et al. | 428/402.21 |
| 4,699,866 | 10/1987 | Naoi et al. | 430/138 |
| 4,758,506 | 7/1988 | Lok et al. | 430/903 |
| 4,877,706 | 10/1989 | Mahabadi et al. | 430/138 X |
| 5,015,549 | 5/1991 | Grosso et al. | 430/138 X |

FOREIGN PATENT DOCUMENTS

| | | | |
|---|---|---|---|
| 174061 | 7/1988 | Japan | 430/109 |

*Primary Examiner*—Roland Martin
*Attorney, Agent, or Firm*—E. O. Palazzo

[57] ABSTRACT

An encapsulated toner composition comprised of a core comprised of a polymer binder, pigment, dye, or mixtures thereof, and a hydroxylated polyurethane microcapsule shell derived from the polycondensation of a polyisocyanate and a water soluble carbohydrate.

51 Claims, No Drawings

ENCAPSULATED TONER COMPOSITIONS

BACKGROUND OF THE INVENTION

The present invention is generally directed to toner compositions, and more specifically to encapsulated toner compositions. In one embodiment, the present invention relates to encapsulated toner compositions comprised of a core comprised of a polymer binder and colorants, including pigments, dyes, or mixtures thereof, and a polymeric shell thereover prepared, for example, by interfacial polymerization. Another embodiment of the present invention relates to shell formation by interfacial polycondensation of a polyisocyanate with a polyol, that is, for example, a carbohydrate having a functionality equal to or greater than that of the polyisocyanate, such as a low molecular weight carbohydrate. The core polymer binder can be generated by the addition polymerization of vinyl monomers after microcapsule shell formation. Specifically, in an embodiment the aforementioned shell forming interfacial polycondensation can be accomplished in the presence of a molar excess of the carbohydrate, or its derivatives. The hydroxylated polyurethane shell thus formed possesses a high degree of hydroxy substitution, and as a result is rendered polar in nature, and is accordingly very effective in containing the relatively nonpolar core polymer binder. Effective containment of core components can be of importance for encapsulated toners since core component leaching could, and in many instances, if not all, causes toner agglomeration and blocking, and the resultant toners would be inferior in performance. These and other disadvantages are eliminated or minimized with the toners of the present invention. In another specific embodiment, the present invention is directed to encapsulated toner compositions which provide high fix images under low pressure fixing conditions, and which toners are comprised of a core of polymer binders and colorants, preferably magnetic pigments such as magnetites, encapsulated thereover by a hydroxylated polyurethane shell derived from the polycondensation of a diisocyanate, a triisocyanate or mixtures thereof with a low molecular weight carbohydrate derivative such as monosaccharides or disaccharides. The fix level of developed image of an encapsulated toner under pressure fixing conditions is generally dependent on the rate of the diffusion of its core components, primarily the core resin, out of the ruptured toner to fix to paper; the fix level accordingly can be considered a function of time, and the optimum fix is usually achieved about several hours to 24 hours after the toner is ruptured. The initial fix, that is the fix level after 1 or 2 minutes of toner rupture, of a number of encapsulated toners at low fixing pressure of, for example, about 2,000 psi is usually from about 5 to 30 percent. This marginal initial fix may not be sufficient with regard to duplex printing since the low initial fix may cause image offset to the pressure roll or severe image smear during the duplex printing process. Accordingly, a specific embodiment of the present invention is to provide encapsulated toner compositions which also offer high initial fix of, for example, in excess of about 40 to about 50 percent, and which toners are obtained by encapsulating a core composition of a polymer binder and a colorant with a hydroxylated polyurethane shell derived from interfacial polycondensation of a polyisocyanate and a monosaccharide or disaccharide, or mixtures thereof, selected from the group consisting of ribose, arabinose, xylose, glucose, gluconolactone, methyl glucopyranoside, mannose, methyl mannopyranoside, galactose, methyl galactopyranoside, sorbose, fructose, maltose, cellobiose, lactose, lactobionic acid and sucrose, and the like. The aforementioned relatively high level of initial fix is believed to be sufficient to overcome the image offset and image smear problems in duplex printing. The aforementioned toners possess a number of advantages as illustrated herein including a high initial fix of developed image to paper of about 40 to about 50 percent within, for example, from about 1 to about 2 minutes after fixing, and a final fix of at least about 85 percent at low fixing pressure of, for example, 2,000 psi in embodiments thereby enabling duplex imaging and printing processes to be properly accomplished; preventing or minimizing leaching or loss of the core components especially the core binder; avoidance or minimization of agglomeration; elimination and/or the minimization of image ghosting; and acceptable powder flow characteristics and surface release properties. In another embodiment of the present invention, the toner compositions obtained can include thereon an electroconductive material thereby permitting compositions with a controlled and stable volume resistivity such as, for example, from about $10^3$ to about $10^8$ ohm-cm, and preferably from about $10^4$ to about $10^7$ ohm-cm, which toners are particularly useful for inductive single component development processes. The toner compositions of the present invention also provide a shell with substantially improved mechanical properties, and which shell does not rupture prematurely causing the core component comprised, for example, of a polymer and magnetite, or other pigment to become exposed, and contaminating the image development subsystem surfaces or forming undesirable agglomerates. The toners of the present invention also provide for a complete or substantially complete transfer of toned images to a paper substrate during the development process. The toner compositions of the present invention can be selected for a variety of known reprographic imaging processes including electrophotographic and ionographic processes. In embodiments, the toner compositions of the present invention are selected for pressure fixing processes for ionographic printing wherein dielectric receivers, such as silicon carbide, are utilized, reference U.S. Pat. No. 4,885,220, the disclosure of which is totally incorporated herein by reference. Specifically, the toner compositions of the present invention can be selected for image development in commerical Delphax printers such as the Delphax S9000 TM, S6000 TM, S4500 TM, S3000 TM, and Xerox Corporation printers such as the 4060 TM and 4075 TM wherein, for example, transfixing is utilized, that is fixing of the developed image is accomplished by simultaneously transferring and fixing the developed images to a paper substrate with pressure. Another application of the toner compositions of the present invention resides in its use for two component development systems wherein, for example, the image toning and transfer are accomplished electrostatically, and the fixing of the transferred image is achieved by application of pressure with or without the assistance of thermal energy.

The toner compositions of the present invention can, in embodiments, be prepared by a shell forming interfacial polycondensation, followed by an in situ core polymer binder forming free radical polymerization of an addition monomer or monomers initiated by thermal decomposition of a free radical initiator. One embodiment of the present invention is directed to a process for a simple and economical preparation of pressure fixable encapsulated toner compositions by a chemical microencapsulation method involving an interfacial polycondensation and a free radical polymerization, and wherein there are selected, for example, acrylates, methacrylates or styryl derivatives as core monomers, pigments or dyes as colorants, and polyisocyanates and monosaccharides or disaccharides as shell precursors to provide an encapsulated toner with a hydroxylated polyurethane shell. Further, in another process aspect of the present invention the encapsulated toners can be prepared in the absence of flammable organic solvents, thus eliminating explosion hazards associated therewith; and furthermore, these processes do not require the expensive and hazardous solvent separation and recovery steps. Moreover, with the process of the present invention there can be obtained in some instances improved yields of toner products since, for example, the extraneous solvent component can be replaced by liquid shell and core precursors.

The toner compositions of the present invention contain hydroxylated polyurethane shell materials that permit attainment of high fixed images, in particular images with a high initial fix level, while simultaneously enabling effective containment or substantial retention of the core components, thus eliminating or substantially suppressing core binder diffusion and leaching. As a consequence, the problems of toner agglomeration and image ghosting are eliminated or substantially alleviated. Furthermore, the toner compositions of the present invention improve the efficiency of the image transfer process to substrates such as paper in many embodiments. Also, with the toner compositions of the present invention, particularly with respect to their selection for inductive single component development processes, the toner particles contain on their surfaces a uniform and substantially permanently attached electroconductive material thereby imparting certain stable electroconductive characteristics to the particles inclusive of situations wherein these particles are subjected to vigorous agitation. With a number of the prior art toners, the surface conductivity properties of the toner particles may be unstable when subjected to agitation, especially, for example, when electroconductive dry surface additives such as carbon black are selected. Further, with the aforementioned prior art toner compositions there are usually obtained images of low quality with substantial background deposits, particularly after a number of imaging cycles, especially subsequent to vigorous mechanical agitation which results in toner electroconductivity instability as, for example, the additives such as carbon black are not permanently retained on the surface of the toner. Additionally, several of the cold pressure fixing toner compositions of the prior art have other disadvantages in that, for example, these compositions are obtained by processes which utilize flammable organic solvents. The utilization of flammable organic solvents renders the preparative process costly and potentially hazardous since most of these solvents are explosion prone and require costly explosion-proof equipment, and such processes also require expensive solvent separation and recovery steps. Moreover, the inclusion of solvents also decreases the toner throughtput yield per unit volume of reactor size. Furthermore, with many of the prior art processes toners of narrow size dispersity cannot be easily achieved as contrasted with the process of the present invention where narrow particle size distributions are generally obtained. In addition, a number of prior art processes provide deleterious effects on toner particle morphology and bulk density as a result of the removal of solvent and the subsequent collapse or shrinkage of toner particles during the toner work-up and isolation processes resulting in a toner of very low bulk density. These disadvantages are substantially eliminated with the toners and processes of the present invention in some embodiments thereof. More specifically, thus with the encapsulated toners of the present invention control of the toner physical properties of both the core and shell materials can be achieved. Specifically, with the encapsulated toners of the present invention undesirable leaching or loss of core components is avoided or minimized; high initial fix of about 40 to about 50 percent, and a final fix of over 85 percent are obtained; and image ghosting is eliminated in many instances primarily as a result of the use of the polar hydroxylated polyurethane shell. Image ghosting is an undesirable phenomenon commonly encountered in transfix ionographic printing when undesirable toner compositions are utilized. It refers to the repetitious printing of unwarranted images, and arises primarily from the contamination of the dielectric receiver by the unremovable toner materials. This problem can sometimes be partially eliminated by use of suitable surface release agents which aids in the removal of residual toner materials after image transfer. The toner compositions of the present invention eliminate or substantially eliminate the image ghosting problem by providing a microcapsule shell which effectively contains the core binder, inhibiting its leaching, and prevents it from coming into contact with the dielectric receiver during the image transfix process. In addition, the shell materials of the present invention together with the aid of some suitable surface additives also provides excellent surface release properties, thus enabling efficient removal of residual toner materials from the dielectric receiver surface and high image transfer efficiency.

Encapsulated cold pressure fixable toner compositions are known. Cold pressure fixable toners have a number of advantages in comparison to toners that are fused by heat, primarily relating to the utilization of less energy and enabling the use of heatless instant-on imaging apparatus, since the toner compositions selected can be fixed without application of heat. Nevertheless, many of the prior art cold pressure fixable toner compositions suffer from a number of deficiencies. For example, these toner compositions must usually be fixed under high pressure, which has a tendency to severely affect the fixing characteristics of the toner selected. This can result in images of low resolution or definition. High pressure fixing also can result in undesirable paper calendering. Also, with a number of the prior art cold pressure toner compositions substantial image smearing can result from the high pressures used. Many of the prior art cold pressure fixable toner compositions, particularly those prepared by conventional melt blending processes, do not usually provide high image fix levels. Additionally, the cold pressure fixing toner compositions of the prior art have other disadvantages in that, for example, these compositions are generally fixed under high pressure, and provide in some instances, images which are of high gloss and of low crease and rub resistance.

In a patentability search report, the following prior art, all U.S. patents, were recited: U.S. Pat. No. 4,442,194 which discloses encapsulated toners with shells comprised of substances (A) and (B), see column 3 for example, wherein (A) can be an isocyanate and (B) can be an active hydrogen containing compound, see column 4, such as polyols, water, sorbitol, and the like, see column 5; a similar teaching is present in U.S. Pat. No. 4,699,866; U.S. Pat. No. 3,898,171 which discloses an electroscopic powder formulated with sucrose benzoate and a thermoplastic resin, see for example column 2; and U.S. Pat. Nos. 4,465,755 and 4,592,957 as being of possible background interest.

The following U.S. patents located in a patentability search report for encapsulated toners are mentioned: U.S. Pat. No. 3,967,962 which discloses a toner composition comprising a finely divided mixture comprising a colorant and a polymeric material which is a block or graft copolymer, including apparently copolymers of polyurethane and a polyether (column 6), reference for example the Abstract of the Disclosure, and also note the disclosure in columns 2 and 3, 6 and 7, particularly lines 13 and 35; however, it does not appear that encapsulated toners are disclosed in this patent; U.S. Pat. No. 4,565,764 which discloses a microcapsule toner with a colored core material coated successively with a first resin wall and a second resin wall, reference for example the Abstract of the Disclosure and also note columns 2 to 7, and particularly column 7, beginning at line 31, wherein the first wall may comprise polyvinyl alcohol resins known in the art including polyurethanes, polyureas, and the like; U.S. Pat. No. 4,626,490 contains a similar teaching as the '764 patent and more specifically discloses an encapsulated toner comprising a binder of a mixture of a long chain organic compound and an ester of a higher alcohol and a higher carboxylic acid encapsulated within a thin shell, reference the Abstract of the Disclosure, for example, and note specifically examples of shell materials in column 8, beginning at line 64, and continuing on to column 9, line 17, which shells can be comprised, for example, of polyurethanes, polyurea, epoxy resin, polyether resins such as polyphenylene oxide or thioether resin, or mixtures thereof; U.S. Pat. Nos. 4,442,194 and 4,465,755, mentioned herein; and U.S. Patents of background interest include U.S. Pat. No. 4,520,091; 4,590,142; 4,610,945; 4,642,281; 4,740,443 and 4,803,144.

With further specific reference to the prior art, there are disclosed in U.S. Pat. No. 4,307,169, the disclosure of which is totally incorporated herein by reference, microcapsular electrostatic marking particles containing a pressure fixable core, and an encapsulating substance comprised of a pressure rupturable shell, wherein the shell is formed by an interfacial polymerization. One shell prepared in accordance with the teachings of this patent is a polyamide obtained by interfacial polymerization. Furthermore, there are disclosed in U.S. Pat. No. 4,407,922 pressure sensitive toner compositions comprised of a blend of two immiscible polymers selected from the group consisting of certain polymers as a hard component, and polyoctyldecylvinylether-co-maleic anhydride as a soft component. Interfacial polymerization processes are also selected for the preparation of the toners of this patent. Also, there is disclosed in the prior art encapsulated toner compositions usually containing costly pigments and dyes, reference for example the color photocapsule toners of U.S. Pat. Nos. 4,399,209; 4,483,912; and 4,397,483.

Interfacial polymerization processes are described in British Patent Publication 1,371,179, the disclosure of which is totally incorporated herein by reference, which publication illustrates a method of microencapsulation based on in situ interfacial condensation polymerization. More specifically, this publication discloses a process which permits the encapsulation of organic pesticides by the hydrolysis of polymethylene polyphenylisocyanate or toluene diisocyanate monomers. Also, the shell-forming reaction disclosed in the aforementioned publication is initiated by heating the mixture to an elevated temperature at which point the isocyanate monomers are hydrolyzed at the interface to form amines, which then react with unhydrolyzed isocyanate monomers to enable the formation of a polyurea microcapsule wall. Moreover, there is disclosed in U.S. Pat. No. 4,407,922, the disclosure of which is totally incorporated herein by reference, interfacial polymerization processes for pressure sensitive toner compositions comprised of a blend of two immiscible polymers selected from the group consisting of certain polymers as a hard component, and polyoctadecylvinylether-co-maleic anhydride as a soft component.

Furthermore, other prior art, primarily of background interest, includes U.S. Pat. Nos. 4,254,201; 4,465,755 and Japanese Patent Publication 58-100857. The Japanese publication discloses a capsule toner with high mechanical strength, which is comprised of a core material including a display recording material, a binder, and an outer shell, which outer shell is preferably comprised of a polyurea resin. In the '201 patent there are disclosed encapsulated electrostatographic toners wherein the shell material comprises at least one resin selected from polyurethane resins, a polyurea resin, or a polyamide resin. In addition, the '755 patent discloses a pressure fixable toner comprising encapsulated particles containing a curing agent, and wherein the shell is comprised of a polyurethane, a polyurea, or a polythiourethane. Moreover, in the '201 patent there are illustrated pressure sensitive adhesive toners comprised of clustered encapsulated porous particles, which toners are prepared by spray drying an aqueous dispersion of the granules containing an encapsulated material.

Also, there are illustrated in U.S. Pat. No. 4,280,833 encapsulated materials prepared by interfacial polymerization in aqueous herbicidal compositions. More specifically, as indicated in column 4, beginning at line 9, there is disclosed a process for encapsulating the water immiscible material within the shell of the polyurea, a water immiscible organic phase which consists of a water immiscible material, that is the material to be encapsulated, and polymethyl polyphenyl isocyanate is added to the aqueous phase with agitation to form a dispersion of small droplets of the water immiscible phase within the aqueous phase; and thereafter, a polyfunctional amine is added with continuous agitation to the organic aqueous dispersion, reference column 4, lines 15 to 27. Also, note column 5, line 50, wherein the amine selected can be diethylene triamine, and the core material can be any liquid, oil, meltable solid or solvent soluble material, reference column 4, line 30. A similar teaching is present in U.S. Pat. No. 4,417,916.

In U.S. Pat. No. 4,599,271, the disclosure of which is totally incorporated herein by reference, there are illustrated microcapsules obtained by mixing organic materials in water emulsions at reaction parameters that permit the emulsified organic droplets of each emulsion to collide with one another, reference the disclosure in column 4, lines 5 to 35. Examples of polymeric shells are illustrated, for example, in column 5, beginning at line 40, and include isocyanate compounds such as toluene diisocyanate, and polymethylene polyphenyl isocyanates. Further, in column 6, at line 54, it is indicated that the microcapsules disclosed are not limited to use on carbonless copying systems; rather, the film material could comprise other components including xerographic toners, see column 6, line 54.

Other prior art includes U.S. Pat. No. 4,520,091, the disclosure of which is totally incorporated herein by reference, which illustrates an encapsulated toner material wherein the shell can be formed by reacting a compound having an isocyanate with a polyamine, reference column 4, lines 30 to 61, and column 5, line 19; and U.S. Pat. No. 3,900,669 illustrating a pressure sensitive recording sheet comprising a microcapsule with polyurea walls, and wherein polymethylene polyphenyl isocyanate can be reacted with a polyamine to produce the shell, see column 4, line 34.

Illustrated in U.S. Pat. No. 4,758,506, the disclosure of which is totally incorporated herein by reference, are single component cold pressure fixable toner compositions, wherein the shell selected can be prepared by an interfacial polymerization process. Further in another copending application U.S. Ser. No. 402,306, the disclosure of which is totally incorporated herein by reference, there are illustrated encapsulated toners with a core comprised of a polymer binder, pigment or dye, and thereover a polymeric shell, which contains a soft and flexible component, permitting, for example, proper packing of shell materials resulting in the formation of a high density shell structure, which can effectively contain the core binder and prevent its loss through diffusion and leaching process. The soft and flexible component in one embodiment is comprised of a polyether function. Specifically, in one embodiment there is disclosed in the aforementioned copending application encapsulated toners comprised of a core containing a polymer binder, pigment or dye particles, and thereover a shell preferably obtained by interfacial polymerization, which shell has incorporated therein a polyether structural moiety. Another specific embodiment of the copending application is directed to encapsulated toners comprised of a core of polymer binder, pigment, dye or mixtures thereof, and a polymeric shell of a polyether-incorporated polymer, such as a poly(ether urea), a poly(ether amide), a poly(ether ester), a poly(ether urethane), mixtures thereof, and the like. With the toner compositions of the present invention, advantages in embodiments thereof include: (1) high fixing, and both high initial and high final image fix levels under low pressure fixing conditions; (2) utilization of a novel class of hydroxylated polyurethane shells derived from polycondensation of low molecular weight carbohydrates and polyisocyanates; (3) the shell materials suppress or inhibit core binder diffusion and leaching process through the incompatibility of the shell and core material; (4) the avoidance in embodiments of the relatively toxic polyamines in the preparation thereof; and (5) in some process embodiments, the effluents from the reaction and post-reaction washings during toner preparation do not require costly special waste treatments since polyamines are not utilized.

Accordingly, there is a need for encapsulated toner compositions with many, and in some embodiments substantially, if not all, the advantages illustrated herein. More specifically, there is a need for encapsulated toners with shells that eliminate or minimize the loss of core components such as the binder resin. Also, there is a need for encapsulated toners wherein images with excellent resolution and superior initial and final image fix can be obtained. Moreover, there is a need for encapsulated toners, including colored toners, wherein image ghosting and smear, toner offsetting, and undersirable leaching of core components and the like are avoided or minimized. Additionally, there is a need for encapsulated toners, including colored toners with, in some instances, excellent surface release characteristics enabling efficient image transfer during image development and fixing processes. Furthermore, there is a need for encapsulated toners which have been surface treated with additives such as carbon blacks, graphite or the like to render them conductive to a volume resistivity level of preferably from about $10^3$ to $10^8$ ohm-cm, and to enable their use in single component inductive development systems. Moreover, there is a need for pressure fixable encapsulated toners that can be utilized in the transfix development systems under low pressure fixing conditions. There is also a need for processes for the preparation of encapsulated toners with the advantages mentioned herein. Specifically, there is a need for chemical microencapsulation preparative techniques for encapsulated toner compositions, which involve a shell forming interfacial polycondensation process and a core binder forming free radical polymerization process. Furthermore, there is a need for toners and improved processes thereof that will enable the preparation of encapsulated toner compositions whose properties, such as shell strength, core binder molecular weight and the nature of core binder crosslinking, can be desirably controlled.

SUMMARY OF THE INVENTION

It is a feature of the present invention to provide encapsulated toner compositions with many of the advantages illustrated herein.

It is also a feature of the present invention to provide encapsulated toner compositions which provide desirable toner properties such as high initial and final image fix, excellent image crease and rub resistance, and excellent image permanence characteristics.

In another feature of the present invention there are provided encapsulated toner compositions comprised of a core of polymer binder, colorants such as pigments or dyes, or mixtures thereof, and thereover a microcapsule shell prepared, for example, by interfacial polymerization, and which shell material is a hydroxylated polyurethane.

Another feature of the present invention is the provision of encapsulated toners wherein image ghosting is eliminated in some embodiments, or minimized in other embodiments.

Further, another feature of the present invention is the provision of encapsulated toners wherein toner agglomeration is eliminated in some embodiments, or minimized in other embodiments.

Also, another feature of the present invention is the provision of encapsulated toners wherein core component leaching or loss is eliminated in some embodiments, or minimized in other embodiments.

Moreover, another feature of the present invention is the provision of encapsulated toners wherein toner offsetting is eliminated in some embodiments, or minimized in other embodiments.

It is another feature of the present invention to provide encapsulated toners wherein the contamination of the imaging member, such as dielectric receiver, including electroreceptors, is eliminated or minimized.

Another feature of the present invention is the provision of encapsulated toners that can be selected for imaging processes, especially processes wherein pressure fixing is selected.

A further feature of the present invention relates to pressure fixable encapsulated toner compositions suitable for inductive single component transfix development under low fixing pressure.

In another feature of the present invention there are provided simple and economical preparative processes for black and colored toner compositions involving an interfacial shell forming polymerization and an in situ free radical core binder forming polymerization whereby the shell formation, core binder formation, and the resulting toner material properties can be independently and desirably controlled.

Another feature of the present invention resides in the provision of simple and economical processes for black and colored pressure fixable toner compositions with durable, pressure-rupturable shells obtained by a chemical microencapsulation technique involving an interfacial polycondensation and a free radical polymerization process.

Moreover, in a further feature of the present invention there are provided processes for pressure fixable toner compositions wherein the core binders thereof are obtained via free radical polymerization of liquid vinyl monomers, and which monomers also serve as a diluent and as a reaction medium for polymerization, thus eliminating the utilization of undesirable organic solvents in the preparation process.

Another feature is the provision of encapsulated toner compositions comprised of a core of acrylate binder, methacrylate binder, styryl binder, or their copolymeric binder, and a colorant or colorants, encapsulated within a polymeric shell derived from polycondensation of a polyisocyanate and a low molecular weight carbohydrate such as monosaccharide or disaccharide.

These and other features of the present invention can be accomplished by the provision of toners and, more specifically, encapsulated toners. In one embodiment of the present invention, there are provided encapsulated toners with a core comprised of a polymer binder, pigment or dye, and thereover a hydroxylated polyurethane shell, and which shell has the ability to effectively contain the core binder and prevent its loss through diffusion and leaching process. Specifically, in one embodiment there is provided in accordance with the present invention encapsulated toners comprised of a core containing a polymer binder, pigment or dye particles, and thereover a hydroxylated polyurethane shell derived from the polycondensation of a polyisocyanate and a water-soluble carbohydrate such as a monosaccharide, a disaccharide or their derivatives, with the polycondensation being accomplished by the known interfacial polymerization methods. Another specific embodiment of the present invention is directed to pressure fixable encapsulated toners comprised of a core of polymer binder, magnetic pigment, color pigment, dye or mixtures thereof, and a hydroxylated polyurethane shell, and coated thereover with a layer of conductive components such as carbon black.

The aforementioned toners of the present invention can be prepared by a chemical microencapsulation process comprising an interfacial polycondensation and a free radical polymerization. This toner preparative process comprises dispersing a mixture of core monomers, colorants, free radical initiators, and one or more water immiscible polyisocyanates into stabilized microdroplets in an aqueous medium containing an emulsifying agent or a stabilizer. The nature and concentration of the emulsifying agent or stabilizer employed in the generation of the stabilized microdroplets depend on a number of factors including, for example, the toner components, the viscosity of the mixture, and the desired toner particle size. The shell forming interfacial polymerization can be effected by the addition of a water soluble polyol, such as a low molecular weight carbohydrate, into the reaction medium. The polyol from the aqueous phase reacts with the polyisocyanates from the microdroplet phase at the microdroplet/water interface resulting in the formation of a microcapsule shell around the microdroplet. The generation of the core binder from the core monomers within the newly formed microcapsule is subsequently initiated by heating, thus completing the formation of an encapsulated toner particle of the present invention. In a specific embodiment, the present invention relates to the provision of a pressure fixable encapsulated toner comprised of a core of a polymer binder obtained preferably by free radical polymerization of addition monomers, magnetic pigment, such as iron oxide or magnetite, encapsulated thereover with a hydroxylated polyurethane shell obtained by interfacial polycondensation of a monosaccharide or disaccharide with a polyisocyanate, and wherein the properties of the shell can be tailored to specific specifications by, for example, controlling the nature, amount and stoichiometry of shell precursors. The core polymer binder in embodiments can be obtained by in situ free radical polymerization of addition monomers within the microcapsules after shell formation.

The water soluble carbohydrate that can be selected for forming the toner shells of the present invention are monosaccharides, disaccharides, or their derivatives having a functionality of greater than 2, and preferably at least 3. Specifically, monosaccharides, disaccharides and their derivatives can be selected from the group consisting of ribose, arabinose, xylose, glucose, gluconolactone, methyl glucopyranoside, mannose, methyl mannopyranoside, galactose, methyl galactopyranoside, sorbose, fructose, maltose, cellobiose, lactose, lactobionic acid, sucrose, and the like. Illustrative examples of polyisocyanates that can be utilized for reaction with the aforementioned polyols are polyisocyanates selected, for example, from the group consisting of benzene diisocyanate, toluene diisocyanate, diphenylmethane diisocyanate, 1,6-hexamethylene diisocyanate, bis(4-isocyanatocyclohexyl)methane, MODUR CB-60, MONDUR CB-75, MONDUR MR, MONDUR MRS 10, PAPI 27, PAPI 135, Isonate 143L, Isonate 181, Isonate 125M, Isonate 191, Isonate 240, Uniroyal Chemical's polyether Vibrathanes B-604, B-614, B-635, B-843, Mobay Chemical Corporation's polyether isocyanate prepolymers E-21 or E-21A, XP-743, XP-744, and the like. Generally, a 1 to 15 percent molar excess of polyols to polyisocyanates is employed in the shell formation, and the shell generally comprises from about 5 to 30 weight percent, and preferably from about 8 to about 20 weight percent of the final toner composition. The shell can be of an effective thickness of, for example, less than about 5 microns as indicated herein. During the aforementioned shell forming interfacial polycondensation, the temperature can be maintained at from about 15° C. to about 55° C., and preferably from about 20° C. to about 35° C. Also, the reaction time is generally from about 5 minute to about 5 hours, and preferably from about 20 minutes to about 90 minutes.

Other polyisocyanates may also be selected for reaction with polyol to enable shell formation by interfacial polymerization, reference for example U.S. Pat. No. 4,612,272, and U.K. Patents 2,107,670 and 2,135,469, the disclosures of which are totally incorporated herein by reference. Interfacial processes selected for the shell formation of the toners of the present invention are as illustrated, for example, in U.S. Pat. Nos. 4,000,087 and 4,307,169, the disclosures of which are totally incorporated herein by reference.

Illustrative examples of core monomers, which are subsequently polymerized after microcapsule shell formation, and are present in an effective amount of from, for example, about 15 to about 90 weight percent, and preferably from about 20 to about 50 weight percent, include acrylates, methacrylates, olefins including styrene and its derivatives, and the like. Specific examples of core monomers include methyl acrylate, methyl methacrylate, ethyl acrylate, ethyl methacrylate, propyl acrylate, propyl methacrylate, butyl acrylate, butyl methacrylate, pentyl acrylate, pentyl methacrylate, hexyl acrylate, hexyl methacrylate, heptyl acrylate, heptyl methacrylate, octyl acrylate, octyl methacrylate, cyclohexyl acrylate, cyclohexyl methacrylate, lauryl acrylate, lauryl methacrylate, stearyl acrylate, stearyl methacrylate, benzyl acrylate, benzyl methacrylate, ethoxypropyl acrylate, ethoxypropyl methacrylate, methylbutyl acrylate, methylbutyl methacrylate, ethylhexyl acrylate, ethylhexyl methacrylate, methoxybutyl acrylate, methoxybutyl methacrylate, cyanobutyl acrylate, cyanobutyl methacrylate, tolyl acrylate, tolyl methacrylate, styrene, substituted styrenes, other substantially equivalent addition monomers, and other known addition monomers, reference for example U.S. Pat. No. 4,298,672, the disclosure of which is totally incorporated herein by reference, and mixtures thereof.

Various known pigments that can be selected include carbon black, magnetites, such as Mobay magnetites MO8029, MO8060; Columbian Mapico Blacks and surface treated magnetites; Pfizer magnetites CB4799, CB5300, CB5600, MCX636; Bayer magnetites Bayferrox 8600, 8610; Northern Pigments magnetites, NP-604, NP-608; Magnox magnetites TMB-100 or TMB-104; and other similar black pigments, including mixtures of these pigments with other colored pigments illustrated herein. As colored pigments there can be selected Heliogen Blue L6900, D6840, D7080, D7020, Pylam Oil Blue and Pylam Oil Yellow, Pigment Blue 1 available from Paul Uhlich & Company, Inc., Pigment Violet 1, Pigment Red 48, Lemon Chrome Yellow DCC 1026, E. D. Toluidine Red and Bon Red C available from Dominion Color Corporation, Ltd., Toronto, Ontario, NOVAperm Yellow FGL, Hostaperm Pink E available from Hoechst, Cinquasia Magneta available from E. I. DuPont de Nemours & Company, and the like. Primary colored pigments, that is cyan, magenta, or yellow pigments, can also be selected for the toner compositions of the present invention. Examples of magenta materials that may be selected as pigments include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyan materials that may be used as pigments include copper tetra-4-(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellow pigments that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, and Permanent Yellow FGL. The aforementioned pigments can be incorporated into the microencapsulated toner compositions of the present invention in various effective amounts. In one embodiment, the pigment particles are present in the toner composition in an amount of from about 2 percent by weight to about 65 percent by weight calculated on the weight of the dry toner.

Surface additives that can be selected to, for example, improve the surface characteristics of the toners in embodiments of the present invention include, for example, metal salts, metal salts of fatty acids, colloidal silicas, mixtures thereof and the like, which additives are usually present in an amount of from about 0.1 to about 5 weight percent, reference U.S. Pat. Nos. 3,590,000; 3,720,617; 3,655,374 and 3,983,045, the disclosures of which are totally incorporated herein by reference. Preferred surface additives include zinc stearate and Aerosil R972.

The aforementioned toner compositions of the present invention can be prepared by a number of different processes as indicated herein including the chemical microencapsulation technique which involves a shell forming interfacial polycondensation and an in situ core binder forming free radical polymerization. The process is comprised, for example, of first thoroughly mixing or blending a mixture of core binder monomer or monomers, a free radical initiator, a colorant or mixture of colorants including magnetites, and a polyisocyanate or polyisocyanates; dispersing the aforementioned well blended mixture by high shear blending into stabilized microdroplets of specific droplet size and size distribution in an aqueous medium containing a suitable stabilizer or emulsifying agents, and wherein the volume average microdroplet diameter can be desirably adjusted to be from about 5 microns to about 30 microns with the volume average droplet size dispersity being less than 1.4 as inferred from the Coulter Counter measurements of the microcapsule particles after encapsulation; subsequently subjecting the aforementioned dispersion to the shell forming interfacial polycondensation by adding a polyol or polyols selected preferably from low molecular weight carbohydrates such as monosaccharides or disaccharides; and thereafter initiating the core binder forming free radical polymerization within the newly formed microcapsules with heat. The shell forming interfacial polycondensation is generally executed at ambient temperature, but elevated temperatures may also be employed depending on the nature and functionality of the shell components used. For the core binder forming free radical polymerization, it is generally accomplished at temperatures from ambient temperature to about 100° C., and preferably from ambient temperature to about 85° C. In addition, more than one initiator may be utilized to enhance the polymerization conversion, and to generate the desired molecular weight and molecular weight distribution.

Illustrative examples of free radical initiators that can be selected include azo compounds such as 2-2'-azodimethylvaleronitrile, 2-2'-azoisobutyronitrile, azobiscyclohexanenitrile, 2-methylbutyronitrile, or mixtures thereof, and other similar known compounds with the quantity of initiators being, for example, from about 0.5 percent to about 10 percent by weight of that of core monomers. Stabilizers selected include water soluble polymeric surfactants such as poly(vinyl alcohols), partially hydrolyzed poly(vinyl alcohols), hydroxypropyl cellulose, and methyl cellulose with a stabilizer to water ratio of from about 0.05 to about 0.75 for example.

The encapsulated toner compositions of the present invention are mechanically stable and possess acceptable shelf life stability in most, if not all, embodiments thereof. For example, they do not suffer from premature rupture, and are nonblocking and nonagglomerating. The shell materials of the present invention are robust and display a low degree of shell permeability to the core components, and in particular to the core binder. In addition, the toner compositions of the present invention enable the achievement of a relatively high initial fix of, for example, 50 percent, thereby permitting the toner compositions to be utilized in duplex printing and imaging systems without undue complications such as image offset or image smear. Furthermore, the toner compositions of the present invention also offer in some embodiments very high final image fix of 85 to 95 percent, thereby ensuring excellent image permanence characteristics for high quality printing.

Also, the toner compositions can be rendered conductive with, for example, a volume resistivity value of from about $10^3$ ohm-cm to about $10^8$ ohm-cm by adding to the toner surface thereof components such as carbon blacks, graphite, and other conductive organometallic compounds. The aforementioned conductive toner compositions of the present invention are particularly useful for the inductive development of electrostatic images. More specifically, in accordance with the present invention, there is provided a method for developing electrostatic images which comprises forming latent electrostatic images on a hard dielectric surface of an image cylinder by depositing ions from a corona source; developing the images with the single component magnetic toner composition illustrated herein; followed by simultaneous transferring and fixing by pressure onto paper with a toner transfer efficiency greater than 95 percent, and in many instances over 99 percent. The transfix pressure utilized for image fixing is generally less than 1,000 psi to about 4,000 psi, but preferably the transfix pressure is set at 2,000 psi to eliminate or alleviate the paper calendering and high image gloss problems. Examples of pressure fixing processes and systems that can be selected include those commercially available from Delphax, Inc., Hitachi Corporation, and Cybernet, Inc.

The present invention is directed to methods for the development of images by, for example, forming by ion deposition on an electroreceptor, such as a polymer impregnated anodized aluminum oxide, a latent image, developing this image with the pressure fixable encapsulated toner compositions of the present invention, and subsequently simultaneously transferring and fixing the image to a suitable substrate such as paper.

For two component developers, carrier particles including steel ferrites, copper zinc ferrites, and the like, with or without coatings, can be admixed with the encapsulated toners of the present invention, reference for example the carriers illustrated in U.S. Pat. Nos. 4,937,166; 4,935,326; 4,560,635; 4,298,672; 3,839,029; 3,847,604; 3,849,182; 3,914,181; 3,929,657 and 4,042,518, the disclosures of which are totally incorporated herein by reference.

The following examples are being submitted to further define various species of the present invention. These examples are intended to be illustrative only and are not intended to limit the scope of the present invention.

EXAMPLE I

An 18.6 micron (volume average diameter) encapsulated toner with a hydroxylated polyurethane shell derived from α-D-glucose and Isonate 143L, and a core of poly(lauryl methacrylate) and magnetite was prepared as follows:

A mixture of lauryl methacrylate (135.0 grams), 2,2'-azo-bis-(2,4-dimethyl-valeronitrile) (2.62 grams), 2,2'-azobis-(isobutyronitrile) (2.62 grams), and Isonate 143L (47.0 grams) was homogenized in a 2 liter Nalgene container with an IKA polytron at 4,000 RPM for 30 seconds. To this mixture were then added Northern Pigments' magnetite NP-608 (280.0 grams) and dichloromethane (20 milliliters), and the corresponding slurry was homogenized at 8,000 RPM for four minutes. To the resulting mixture was added 1 liter, 0.10 percent (by weight), of aqueous poly(vinyl alcohol) (88 percent hydrolyzed; MW 96,000) solution, and thereafter, the mixture was homogenized again at 9,000 RPM for 2 minutes. The resulting dispersion was transferred to a 2 liter reaction kettle immersed in an oil bath, and equipped with a mechanical stirrer. To the kettle was then added a solution of α-D-glucose (29.5 grams) in 80 milliliters of water, and the resulting mixture was allowed to react for 1 hour. Thereafter, the kettle was heated to 85° C. over a period of 1.5 hours, and polymerization was continued at this temperature for 6 hours before cooling down to room temperature, about 25° C. The resulting mixture was then transferred to a 4 liter beaker, and diluted with water to a volume of about four liters with constant stirring. The encapsulated particles were allowed to settle to the bottom of the beaker by gravity, and the aqueous supernatant was carefully decanted. The washing was repeated in this manner for several times until the washing was clear. The washed encapsulated particles were transferred to a 2 liter beaker and diluted with water to a total volume of 1.8 liters. A suspension of Aquadag graphite E (19.9 grams, from Acheson Colloids) in water (100 milliliters) was then added, and the mixture was spray dried in a Yamato Spray Dryer at an air inlet temperature of 160° C., and an air outlet temperature of 80° C. The air flow was maintained at 0.75 $m^3$/minute, while the atomizing air pressure was set at 1.0 kilogram/$cm^2$. The collected dry encapsulated particles (260.0 grams) were screened through a 63 micron sieve; the particle's volume average particle diameter, as measured on a 256 channel Coulter Counter, was 18.6 microns with a volume average particle size dispersity of 1.37.

Two hundred and forty (240.0) grams of the above encapsulated particles were dry blended using a Greey blender, first with 0.77 gram of carbon black (Black Pearls 2,000) for 2 minutes at 3,500 RPM, and then with 3.6 grams of zinc stearate for an additional 10 minutes at 3,000 RPM to provide a final encapsulated toner product with a volume resistivity of $6.3\times10^4$ ohm-cm.

The pressure fixing ionographic printer selected for the testing of the toner compositions was the Delphax S-6000 TM printer. The developed images were transfixed at a pressure of 2,000 psi. Print quality was evaluated from a checkerboard print pattern. The image optical density was measured using a standard integrating densitometer. Image fix was measured by the standardized tape pull method wherein a tape was pressed with a uniform reproducible standard pressure against an image and then removed. The image fix level is expressed as a percentage of the retained image optical density after the tape test relative to the original image optical density. Image ghosting was evaluated qualitatively for over 2,000 prints. Toner shell integrity was judged qualitatively by observing any crushed or agglomerated toner on the hopper screen through which toner was fed to the machine magnetic roller. If crushed toner was found to adhere to and clog some of the screen openings after 2,000 copies, it was judged to have a premature toner rupture problem.

For the encapsulated toner as obtained in this example, the initial and final fix levels were, respectively, 52 percent and 93 percent. No image ghosting and toner agglomeration were observed for 2,000 prints.

EXAMPLE II

A 19.2 micron encapsulated toner with a hydroxylated polyurethane shell derived from sucrose and Isonate 143L, and a core of poly(lauryl methacrylate) and a magnetite was prepared as follows:

A mixture of lauryl methacrylate (135.0 grams), 2,2'-azo-bis-(2,4-dimethylvaleronitrile) (2.62 grams), 2,2'-azobis-(isobutyronitrile) (2.62 grams) and Isonate 143L (47.0 grams) was homogenized in a 2 liter Nalgene container with an IKA polytron at 4,000 RPM for 30 seconds. To this mixture were then added Northern Pigments' magnetite NP-608 (280.0 grams) and dichloromethane (20 milliliters), and the corresponding slurry homogenized at 8,000 RPM for four minutes. To the resulting mixture was then added 1 liter, 0.10 percent, of aqueous poly(vinyl alcohol) (88 percent hydrolyzed; MW 96,000) solution, and thereafter, the mixture was homogenized at 9,000 RPM for 2 minutes. The resulting dispersion was transferred to a 2 liter reaction kettle immersed in an oil bath equipped with a mechanical stirrer. To the kettle was added a solution of sucrose (56.5 grams) in 80 milliliters of water, and the resulting mixture was allowed to react for one hour. Thereafter, the reaction kettle was heated to 85° C. over a period of 2 hours and retained at this temperature for 6 hours before cooling to room temperature. The resulting mixture was transferred to a 4 liter beaker, and was diluted to a volume of four liters with water under constant stirring conditions. The encapsulated particles were allowed to settle to the bottom of the beaker by gravity, and the aqueous supernatant was carefully decanted. The aforementioned washing was repeated in this manner for several times until the washing was clear. The washed encapsulated particles were transferred to a 2 liter beaker and diluted with water to a total volume of 1.8 liters. A solution of Aquadag E (19.3 grams, from Acheson Colloids) in water (100 milliliters) was then added to the beaker, and the resulting mixture was spray dried in a Yamato Spray Dryer under the conditions as described in Example I. The collected encapsulated particles (308.0 grams) were screened through a 63 micron sieve; the particle's volume average particle diameter, as measured on a 256 channel Coulter Counter, was 19.2 microns with a volume average particle size dispersity of 1.35.

Two hundred and forty (240.0) grams of the encapsulated particles were dry blended using a Greey blender, first with 0.77 gram of carbon black (Black Pearls 2000) for 2 minutes with the blending impeller operating at 3,500 RPM, and then with 3.6 grams of zinc stearate for another 10 minutes at the impeller speed of 3,000 RPM to provide a final toner product with a volume resistivity of $5.5\times10^5$ ohm-cm. This toner was tested in accordance with the procedure of Example I, and the initial and final fix levels of the toner were, respectively, 51 percent and 94 percent. No signs of image ghosting or toner agglomeration were observed.

EXAMPLE III

A 19.8 micron encapsulated toner with a hydroxylated polyurethane shell derived from sucrose and Isonate 143L, and a core of poly(lauryl methacrylate) and a magnetite was prepared in accordance with the procedure of Example II except that 0.13 percent of aqueous poly(vinyl alcohol) solution and 113.0 grams of sucrose were utilized instead of, respectively, 0.10 percent of aqueous poly(vinyl alcohol) solution and 56.5 grams of sucrose. In addition, 21.5 grams, instead of 19.3 grams, of Aquadag graphite were employed during the spray drying process. A total of 290.0 grams of dry encapsulated particles was collected. The particle's volume average particle diameter was measured to be 19.8 microns and its volume average particle size dispersity was 1.26.

One hundred and eighty (180.0) grams of the above encapsulated particles were dry blended using a Greey blender, first with 0.57 gram of carbon black (Black Pearls 2000) for 2 minutes with the blending impeller operating at 3,500 RPM, and then with 2.7 grams of zinc stearate for another 10 minutes at the impeller speed of 3,000 RPM to provide a final toner product with a volume resistivity of $9.0\times10^5$ ohm-cm. This toner displayed no agglomeration on standing for one month, and provided initial and final fix levels of, respectively, 51 percent and 90 percent without image ghosting for 2,000 prints when tested in accordance with the procedure of Example I.

EXAMPLE IV

A 17.7 micron encapsulated toner comprising a hydroxylated polyurethane shell derived from D-fructose and Isonate 143L and a core of poly(lauryl methacrylate) and a magnetite was prepared in accordance with the procedure of Example I except that α-D-glucose was replaced with D-fructose, and that 0.09 percent, instead of 0.10 percent, of aqueous poly(vinyl alcohol) solution was utilized. A total of 324.0 grams of dry encapsulated particles was obtained with the particle's volume average diameter being 17.7 microns, and its volume average particle size dispersity being 1.33. The particles were dry blended in accordance with the procedure of Example I giving a volume resistivity of $8.2\times10^5$ ohm-cm. The toner displayed initial and final fix levels of 54 percent and 95 percent respectively when tested in accordance with the procedure of Example I. No image ghosting or toner agglomeration were observed in the printer testing.

EXAMPLE V

A 18.2 micron encapsulated toner comprising a hydroxylated polyurethane shell derived from α-D-glucose and Isonate 143L, and a core of lauryl methacrylate-stearyl methacrylate copolymer and a magnetite was prepared in accordance with the procedure of Example I with the exceptions that a mixture of lauryl methacrylate (67.5 grams) and stearyl methacrylate (67.5 grams) was utilized instead of just lauryl methacrylate. A total of 311.0 grams of dry encapsulated particles were obtained with the particle's volume average particle diameter being 18.2 microns and its volume average particle size dispersity being 1.34. The encapsulated particles were dry blended in accordance with the procedure of Example I providing a final toner product with a volume resistivity of $3.3\times10^4$ ohm-cm, and when this toner was tested in accordance with the procedure of Example I, substantially similar results were obtained.

EXAMPLE VI

A 19.1 micron encapsulated toner with a hydroxylated polyurethane shell derived from D-fructose and Isonate 143L, and a core of poly(lauryl methacrylate) and a magnetite was prepared in accordance with the procedure of Example I with the exceptions that D-fructose and Mapico Black magnetite were employed in place of α-D-glucose and NP-608 magnetite. A total of 285.0 grams of dry encapsulated particles were obtained with the particle's volume average particle diameter being 19.1 microns and its volume average particle size dispersity being 1.36. The encapsulated particles were dry blended in accordance with the procedure of Example I providing a final toner product with a volume resistivity of $9.5\times10^5$ ohm-cm, and when this toner was tested in accordance with the procedure of Example I, substantially similar results were obtained.

EXAMPLE VII

A 16.6 micron encapsulated toner with a hydroxylated polyurethane shell derived from β-D-lactose and Isonate 143L, and a core of poly(lauryl methacrylate) and a magnetite was prepared in accordance with the procedure of Example I using β-D-lactose and Mapico Black magnetite instead of α-D-glucose and NP-608, respectively. In addition, 0.08 percent instead of 0.10 percent of aqueous poly(vinyl alcohol) was utilized for the particle formation. A total of 328.0 grams of dry encapsulated toner particles was collected with the particle's volume average diameter being 16.6 and the volume average particle size dispersity being 1.34. The encapsulated particles were dry blended in accordance with the procedure of Example I providing a final toner product with a volume resistivity of $7.2\times10^5$ ohm-cm, and when this toner was tested in accordance with the procedure of Example I, substantially similar results were obtained.

EXAMPLE VIII

A 17.2 micron encapsulated toner with a hydroxylated polyurethane shell derived from α-D-lactose and Isonate 143L, and a core of lauryl methacrylate-stearyl methacrylate copolymer binder and a magnetite was prepared in accordance with the procedure of Example VII using α-D-lactose and a mixture of lauryl methacrylate (67.5 grams) and stearyl methacrylate (67.5 grams) instead of, respectively, β-D-lactose and just lauryl methacrylate. A total of 306.0 grams of dry encapsulated particles with a volume average particle size of 17.2 and volume average particle size dispersity of 1.33 were obtained. The encapsulated particles were dry blended in accordance with the procedure of Example I providing a final toner product with a volume resistivity of $5.3\times10^5$ ohm-cm, and when this toner was tested in accordance with the procedure of Example I, substantially similar results were obtained.

Other modifications of the present invention may occur to those skilled in the art subsequent to a review of the present application, and these modifications, including equivalents thereof, are intended to be included within the scope of the present invention.

What is claimed is:

1. An encapsulated toner composition comprised of a core comprised of a polymer binder, pigment, dye, or mixtures thereof, and a hydroxylated polyurethane microcapsule shell derived from the polycondensation of a polyisocyanate and a water soluble carbohydrate.

2. A toner in accordance with claim 1 wherein the functionality of the carbohydrate is equal to or greater than that of polyisocyanate.

3. A toner in accordance with claim 1 wherein the carbohydrate is a monosaccharide or a disaccharide.

4. A toner in accordance with claim 3 wherein the monosaccharide or disaccharide is selected from the group consisting of ribose, arabinose, xylose, glucose, gluconolactone, methyl glucopyranoside, mannose, methyl mannopyranoside, galactose, methyl galactopyranoside, sorbose, fructose, maltose, cellobiose, lactose, lactobionic acid and sucrose.

5. A toner in accordance with claim 3 wherein glucose is selected as the monosaccharide, and sucrose as the disaccharide.

6. A toner in accordance with claim 1 wherein the shell is formed by interfacial polymerization.

7. A toner in accordance with claim 1 wherein the polyisocyanate is selected from the group consisting of benzene diisocyanate, toluene diisocyanate, diphenylmethane diisocyanate, 1,6-hexamethylene diisocyanate, bis(4-isocyanatocyclohexyl)methane, MODUR CB-60, MONDUR CB-75, MONDUR MR, MONDUR MRS 10, PAPI 27, PAPI 135, Isonate 143L, Isonate 181, Isonate 125M, Isonate 191, Isonate 240, polyether Vibrathanes B-604, B-614, B-635, B-843, polyether isocyanate prepolymers E-21 or E-21A, XP-743, and XP-744.

8. A toner in accordance with claim 1 wherein the polyisocyanate is toluene diisocyanate, diphenylmethane diisocyanate, or Isonate 143L.

9. A toner in accordance with claim 1 wherein the core resin binder is an acrylate polymer, a methacrylate polymer, or a styrene polymer.

10. A toner in accordance with claim 1 wherein the core resin binder is a poly(lauryl methacrylate).

11. A toner in accordance with claim 1 wherein the core resin binder is comprised of a copolymer derivative of lauryl methacrylate.

12. A toner in accordance with claim 1 wherein the core resin binder is selected from the group consisting of acrylate copolymers, methacrylate copolymers, styrene and alkyl styrene copolymers.

13. A toner in accordance with claim 1 wherein the core resin binder is derived from polymerization of addition monomers selected preferably from the group consisting of methyl acrylate, methyl methacrylate, ethyl acrylate, ethyl methacrylate, propyl acrylate, propyl methacrylate, butyl acrylate, butyl methacrylate, pentyl acrylate, pentyl methacrylate, hexyl acrylate, hexyl methacrylate, heptyl acrylate, heptyl methacrylate, octyl acrylate, octyl methacrylate, cyclohexyl acrylate, cyclohexyl methacrylate, lauryl acrylate, lauryl methacrylate, stearyl acrylate, stearyl methacrylate, benzyl acrylate, benzyl methacrylate, ethoxypropyl acrylate, ethoxypropyl methacrylate, methylbutyl acrylate, methylbutyl methacrylate, ethylhexyl acrylate, ethylhexyl methacrylate, methoxybutyl acrylate, methoxybutyl methacrylate, cyanobutyl acrylate, cyanobutyl methacrylate, tolyl acrylate, tolyl methacrylate, styrene, and substituted styrenes.

14. A toner in accordance with claim 1 wherein the pigment is carbon black, magnetite, or mixtures thereof.

15. A toner in accordance with claim 14 wherein the magnetite selected is Mapico Black, NP-608, or surface treated magnetites.

16. A toner in accordance with claim 1 wherein the pigment is cyan, yellow, magenta, red, green, blue, brown pigments or mixtures thereof.

17. A toner in accordance with claim 1 wherein the pigment is Heliogen Blue, Pylam Oil Blue, Pylam Oil Yellow, Pigment Blue 1, Pigment Violet 1, Pigment Red, Lemon Chrome Yellow, E.D. Toluidine Red, Bon Red C, NOVAperm Yellow FGL, Hostaperm Pink E, Cinquasia Magenta, Oil Red anthraquinone dye, CI Dispersed Red 15, diazo dye, CI Solvent Red 19, copper tetra-4-(octadecyl sulfonamido) phthalocyanine, X-copper phthalocyanine pigment, CI Pigment Blue, Anthrathrene Blue, diarylide yellow 3,3-dichlorobenzidene acetoacetanilides, CI Solvent Yellow, a nitrophenyl amine sulfonamide, CI Dispersed Yellow 33, 2,5-dimethoxy-4-sulfonanilide phenylazo-4'-chloro-2,5-dimethoxy acetoacetanilide, or Permanent Yellow FGL.

18. A toner in accordance with claim 1 wherein the polymeric shell represents from about 5 percent to about 30 percent by weight of toner, the core binder represents from about 20 percent to about 93 percent by weight of toner, and the pigment, dye or magnetite represents from about 2 percent to about 65 percent by weight of toner.

19. A toner in accordance with claim 1 containing surface additives.

20. A toner in accordance with claim 19 wherein the surface additives are metal salts, metal salts of fatty acids, or colloidal silicas.

21. A toner in accordance with claim 19 wherein zinc stearate is selected.

22. A toner in accordance with claim 19 wherein the surface additives are present in an amount of from about 0.1 to about 5 weight percent.

23. A toner in accordance with claim 1 wherein the toner surface contains conductive components.

24. A toner in accordance with claim 23 wherein the conductive components are comprised of carbon black, graphite, or mixtures thereof.

25. A pressure fixable toner composition comprised of a core comprised of pigment and polymer binder selected from the group consisting of acrylate polymers, methacrylate polymers, and styrene polymers, and which core is encapsulated within a hydroxylated polyurethane shell derived from polycondensation of polyisocyanate and monosaccharide or disaccharide.

26. A toner in accordance with claim 25 wherein the pigment is carbon black, magnetites, or mixtures thereof.

27. A toner in accordance with claim 25 wherein the pigment is cyan, magenta, yellow, red, blue, green, brown pigments, or mixtures thereof.

28. A toner in accordance with claim 25 wherein the shell is formed by the interfacial polymerization method.

29. A toner in accordance with claim 25 wherein the core binder is formed by free radical polymerization of core monomer or monomers during and/or after shell formation.

30. A toner in accordance with claim 29 wherein the core monomer for the core binder is selected from the group consisting of methyl acrylate, methyl methacrylate, ethyl acrylate, ethyl methacrylate, propyl acrylate, propyl methacrylate, butyl acrylate, butyl methacrylate, pentyl acrylate, pentyl methacrylate, hexyl acrylate, hexyl methacrylate, heptyl acrylate, heptyl methacrylate, octyl acrylate, octyl methacrylate, cyclohexyl acrylate, cyclohexyl methacrylate, lauryl acrylate, lauryl methacrylate, stearyl acrylate, stearyl methacrylate, benzyl acrylate, benzyl methacrylate, ethoxypropyl acrylate, ethoxypropyl methacrylate, methylbutyl acrylate, methylbutyl methacrylate, ethylhexyl acrylate, ethylhexyl methacrylate, methoxybutyl acrylate, methoxybutyl methacrylate, cyanobutyl acrylate, cyanobutyl methacrylate, tolyl acrylate, and tolyl methacrylate.

31. A toner in accordance with claim 25 wherein the monosaccharide or disaccharide is selected from the group consisting of ribose, arabinose, xylose, glucose, gluconolactone, methyl glucopyranoside, mannose, methyl mannopyranoside, galactose, methyl galactopyranoside, sorbose, fructose, maltose, cellobiose, lactose, lactobionic acid and sucrose; and the polyisocyante is selected from the group consisting of benzene diisocyanate, toluene diisocyanate, diphenylmethane diisocyanate, 1,6-hexamethylene diisocyanate, bis(4-isocyanatocyclohexyl)methane, PAPI 27, PAPI 135, PAPI 94, PAPI 901, Isonate 143L, Isonate 181, Isonate 125M, Isonate 191, and Isonate 240.

32. A toner in accordance with claim 25 containing surface additives.

33. A toner in accordance with claim 32 wherein the surface additives are metal salts, metal salts of fatty acids, or colloidal silicas.

34. A toner in accordance with claim 33 wherein zinc stearate is selected.

35. A toner in accordance with claim 32 wherein the surface additives are present in an amount of from about 0.1 to about 5 weight percent.

36. A toner in accordance with claim 25 wherein the toner surface contains conductive components.

37. A toner in accordance with claim 36 wherein the conductive components are comprised of carbon black, graphite, or mixtures thereof.

38. A method of imaging which comprises forming by ion deposition on an electroreceptor a latent image, subsequently developing this image with the toner composition of claim 1, and thereafter transferring and fixing the image to a suitable substrate.

39. A method of imaging which comprises forming by ion deposition on an electroreceptor a latent image, subsequently developing this image with the toner composition of claim 25, and thereafter simultaneously transferring and fixing the image to a suitable substrate.

40. A method of imaging in accordance with claim 38 wherein there results images with excellent image fixing characteristics.

41. A method of imaging in accordance with claim 39 wherein there results images with excellent image fixing characteristics.

42. A method of imaging in accordance with claim 38 wherein fixing is accomplished at pressures of from about 500 psi to about 6,000 psi.

43. A method of imaging in accordance with claim 39 wherein fixing is accomplished at pressures of from about 500 psi to about 6,000 psi.

44. A toner composition in accordance with claim 25 wherein the toner's volume resistivity is from about $10^3$ to about $10^8$ ohm-cm.

45. A toner in accordance with claim 1 wherein the carbohydrate is comprised of the derivatives of a monosaccharide or a disaccharide.

46. An encapsulated toner composition comprised of a core comprised of a polymer binder, colorant, and a hydroxylated polyurethane microcapsule shell derived from the polycondensation of a polyisocyanate and a water soluble carbohydrate.

47. A toner in accordance with claim 46 wherein the polyisocyanate is selected from the group consisting of benzene diisocyanate, toluene diisocyanate, diphenylmethane diisocyanate, 1,6-hexamethylene diisocyanate, and bis(4-isocyanatocyclohexyl)methane.

48. A toner in accordance with claim 46 wherein the carbohydrate is a monosaccharide or a disaccharide.

49. A toner in accordance with claim 48 wherein the monosaccharide or disaccharide is selected from the group consisting of ribose, arabinose, xylose, glucose, gluconolactone, methyl glucopyranoside, mannose, methyl mannopyranoside, galactose, methyl galactopyranoside, sorbose, fructose, maltose, cellobiose, lactose, lactobionic acid and sucrose.

50. A toner in accordance with claim 46 wherein the toner surface contains conductive components.

51. A toner in accordance with claim 50 wherein the conductive components are comprised of carbon black, graphite, or mixtures thereof.

* * * * *